US005388178A

United States Patent [19]

Moon

[11] Patent Number: 5,388,178

[45] Date of Patent: Feb. 7, 1995

[54] SAFETY CONTROL SYSTEM OF A BOILING CLOTHES WASHING MACHINE

[75] Inventor: Kyung H. Moon, Kyungki, Rep. of Korea

[73] Assignee: Samsung Electronics Co., Ltd., Suwon, Rep. of Korea

[21] Appl. No.: 963,392

[22] Filed: Oct. 19, 1992

[30] Foreign Application Priority Data

Oct. 19, 1991 [KR] Rep. of Korea ..... 91 18473

[51] Int. Cl.[6] ..... H05B 1/02; D06F 33/02

[52] U.S. Cl. ..... 392/444; 219/497; 219/492; 219/508; 219/437; 392/442; 392/455; 392/451; 68/15; 340/589

[58] Field of Search ..... 219/437, 508, 517, 492, 219/497; 134/57 D, 105-108; 68/15, 16, 12.3; 340/589

[56] References Cited

U.S. PATENT DOCUMENTS

| | | | |
|---|---|---|---|
| 3,614,385 | 10/1971 | Horstmann | 219/517 X |
| 4,405,855 | 9/1983 | Kolle et al. | 219/501 |
| 4,580,421 | 4/1986 | Babuin et al. | 68/12 R |
| 4,668,856 | 5/1987 | Axelson | 219/497 |
| 4,752,671 | 6/1988 | Foster et al. | 392/447 |
| 4,929,930 | 5/1990 | Rezabek | 392/498 X |
| 5,099,108 | 3/1992 | Kimura et al. | 219/497 |

FOREIGN PATENT DOCUMENTS

| | | | |
|---|---|---|---|
| 277551 | 8/1988 | European Pat. Off. | 392/448 |
| 53-14286 | 8/1978 | Japan . | |

*Primary Examiner*—Mark H. Paschall

*Attorney, Agent, or Firm*—Burns, Doane, Swecker & Mathis

[57] ABSTRACT

A safety control system for a boiling clothes washing machine has paired wash water temperature detecting devices and heater temperature detecting devices, for accurately detecting and controlling the temperature of the wash water, and for preventing the heater from overheating. One embodiment of the system, for use in a washing machine including a wash water heater, includes a first water temperature detector for detecting the temperature of wash water by means of direct contact with the wash water; a second water temperature detector for detecting the temperature of wash water by means of direct contact with the wash water; and a circuit, responsive to the second water temperature detector, for controlling the operation of the heater during an abnormal operation of the first water temperature detector. The control system also includes a first heater temperature detector, mounted in a thermally conductive relationship with the heater, for detecting the temperature of the heater; a second heater temperature detector, mounted in a thermally conductive relationship with the heater, for detecting the temperature of the heater; and a circuit, responsive to the second heater temperature detector, for controlling the operation of the heater during an abnormal operation of the first heater temperature detecting means. The control system further includes a processor responsive to the first heater temperature detector, for determining a heater temperature gradient, and for cutting off a power source to the heater in response to the temperature gradient being greater than a reference temperature gradient value.

9 Claims, 2 Drawing Sheets

SAFETY CONTROL SYSTEM OF A BOILING CLOTHES WASHING MACHINE

BACKGROUND OF THE INVENTION

The present invention relates to a safety system of a boiling clothes washing machine for processing clothing with boiling or hot water, and particularly, to a safety control system of a boiling clothes washing machine and a system control method thereof for accurately detecting the temperature of wash water and the temperature of a heater to promote the safety of the system.

FIG. 1 is an illustrative example showing a number of safety devices installed on the bottom surface of a tub in accordance with the present invention, but it is referred to herein because it facilitates an explanation of the background art as well. A conventional washing machine includes a heater 2 mounted between the inner bottom of the tub 1 and the outer bottom of a wash tank 7. The tub 1 includes a metal bracket 3 which projects upward through the bottom surface of the tub 1 with a tight seal being kept between the bracket 3 and the bottom surface of the tub 1. The lower portion of the metal bracket 3 has a recess in the form of a box to receive a thermistor $Th_1$ and a thermostat 36. The heater 2 is always in contact with the upper surface of the bracket 3 in a manner to be immersed. Therefore, the thermistor $Th_1$ and the thermostat 36 detect the temperature of wash water and the heater to enable the heater 2 to be controlled. That is, the temperature detected by the thermistor $Th_1$ is first compared to the temperature of the wash water and then to the temperature of the heater 2 to control the operation of the heater 2. If it is determined that the thermistor $Th_1$ is out of order or has malfunctioned, the thermostat 36 is then required to control the operation of the heater 2.

A conventional safety apparatus only detects the surface temperature of the metal bracket 3, which is taken to be the temperature of the wash water. However, a large error arises between the actual and detected temperatures of the wash water due to the intervening thermal transferring medium, which in this case is the metal bracket 3. For example, the thermistor $Th_1$ may sense that the surface temperature of the metal bracket 3 has increased by about 95° C., causing the power source of the heater 2 to be cut off. However, the actual temperature of the wash water at this point is normally about 50° C. As a result, the conventional washing machine launders clothing with only warm water. The warm water is not expected to wash terribly dirty clothes at the desired optimal cleaning level. It is known through user's experience that the boiling clothing process, in which terribly dirty clothes are allowed to stand in hot water of over 95° C., is a very effective cleaning method. Therefore, it is necessary to accurately detect whether the temperature of wash water is over 95° C.

Thus, it is a main object of the present invention to provide a safety control system and method of a boiling clothes washing machine for accurately detecting the actual temperature of the wash water, controlling a heater based on the detected temperature and performing the boiling wash at a very high temperature.

It is another object of the present invention to provide a safety control system and method of a boiling clothes washing machine for preventing a heater from over-heating while washing clothes with boiling or hot water.

SUMMARY OF THE INVENTION

In order to achieve these objects and features, the present invention comprises a safety control system for a boiling clothes washing machine including a heater mounted through a bracket between a tub and a wash tank, so that the heater heats wash water to process clothing with hot water. The safety control system comprises first wash water temperature detecting means mounted at a location of the inner bottom of the tub that provides contact with wash water to be heated, for detecting the temperature of the wash water. The system also has second wash water temperature detecting means mounted at a location of the inner bottom of the tub that provides contact with the wash water to be heated, for detecting the temperature of the wash water, for controlling the operation of the heater during an abnormal operation of the first means. The system also has first heater temperature detecting means mounted on bracket to provide a thermally conductive relationship with the heater, for detecting the temperature of the heater; and second heater temperature detecting means mounted on the outer upper surface of the bracket to contact with the heater, for detecting the temperature of the heater means responsive the second heater temperature detecting means for controlling the operation of the heater during an abnormal operation of the first heater temperature detecting means.

In accordance with another aspect of the present invention, the safety control system includes water temperature detecting means mounted at a location of the inner bottom of the tub for detecting the temperature of wash water by means of direct contact with the wash water; heater temperature detecting means, mounted on the bracket to provide a thermally conductive relationship with said heater, for detecting the temperature of the heater; and a microcomputer, coupled to the water temperature detecting means and to the heater temperature detecting means, for generating a control signal for cutting off a power source to the heater in response to any of a set of conditions occurring, the set of conditions including the detected water temperature being greater than a first reference water temperature value, the detected heater temperature being greater than a first reference heater temperature value, and a temperature gradient being greater than a reference temperature gradient value, the temperature gradient being defined as a rate of temperature change, and determined from measurements of the detected heater temperature taken during a predetermined time interval. In one embodiment of the present invention, the temperature gradient value is 13° C./min. Also, each of the water temperature detecting means and the heater temperature detecting means may include a thermistor.

The present invention may also further include means, mounted at a location of the inner bottom of the tub for sensing the temperature of wash water by means of direct contact with the wash water, and for cutting off a power source to said heater if the sensed temperature of wash water is greater than a second reference water temperature value, wherein the second reference water temperature value is greater than the first reference water temperature value.

The present invention may also further include means mounted on the bracket to provide a thermally conductive relationship with the heater, for sensing a temperature of the heater, and for cuffing off a power source to the heater if the sensed temperature of the heater is greater than a second reference heater temperature value, wherein the second reference heater temperature value is greater than the first reference heater temperature value.

Thus, the present invention permits the first and second wash water temperature detecting means to detect the actual temperature of wash water at the normal level of wash water over the height of the heater so as to control the operation of the heater. Similarly, the first and second heater temperature detecting means detect the actual temperature of the heater when wash water is at an abnormal level below the height of the heater, so as to control the operation of the heater.

BRIEF DESCRIPTION OF THE DRAWINGS

The present invention will be explained in detail with reference to the attached drawings, in which.

DETAILED DESCRIPTION OF THE INVENTION

Figure 1:
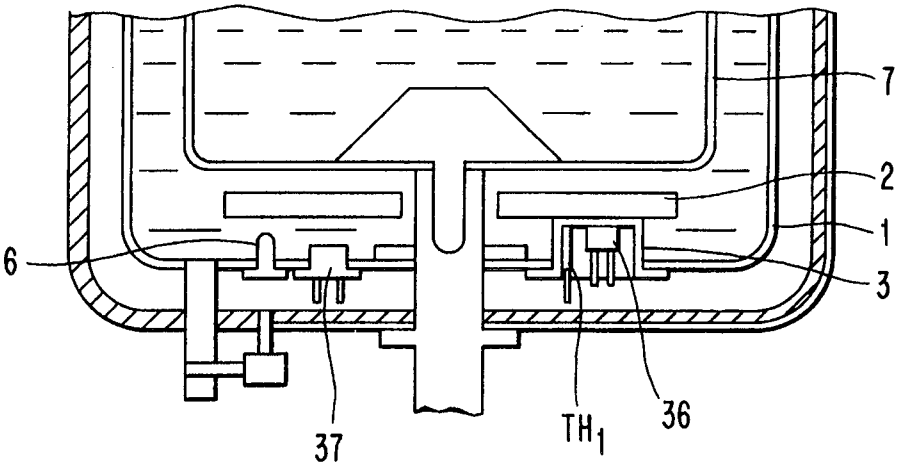
FIG. 1 is an illustrative example showing the mounting of a number of safety devices on the inner bottom surface of a tub according to the present invention; and, FIG. 2 is a schematic block diagram showing a safety control system according to the present invention.

As shown in FIG. 1, this embodiment uses a thermistor $Th_1$ as a first heater temperature detecting device, and a thermostat 36, as a second heater temperature detecting device. These heater temperature detecting devices sense the over-heating of a heater 2 in order to control the operation of the heater 2 when wash water is supplied to a level that is below the position of the heater 2. Such a configuration has already been explained.

Furthermore, first and second wash water temperature detecting devices are respectively constituted as a thermistor 6 and a thermostat 37, which are appropriately mounted on the inner bottom surface of a tub 1 where they will come into contact with the wash water. The thermistor 6 and the thermostat 37 detect the actual temperature of the wash water for controlling the operation of the heater 2 when wash water is supplied to a level that is above the position of the heater 2.

Figure 2:
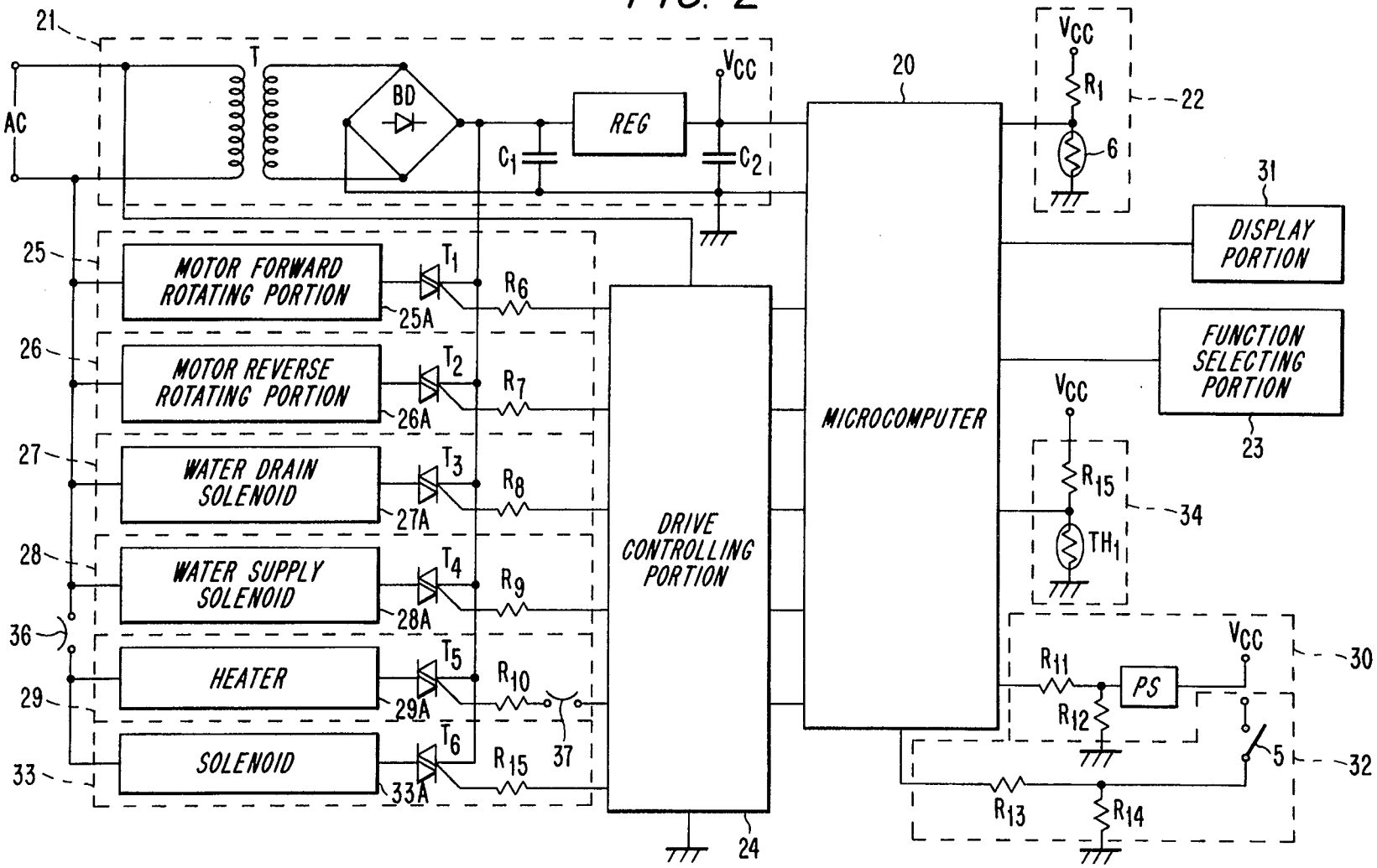

FIG. 2 is a safety control system circuit including a number of safety devices that have been adapted to function in accordance with the present invention. The safety control system circuit is provided with a microcomputer 20 for controlling the total operation of a boiling clothes washing machine according to a predetermined system program.

A power source supply portion 21 is provided with a transformer T, a bridge diode portion BD, condensers $C_1$ and $C_2$ and a precision regulator REG to rectify the alternate current into the constant power source for supplying the regulated voltage Vcc to the system.

A wash water temperature detecting portion 22 according to the present invention is provided with a thermistor 6 and a resistor $R_1$ for sensing the temperature of wash water to be supplied to a tub 1.

A function selecting portion 23 selects the wash mode or procedure and the operating times that correspond to each mode or procedure.

A drive controlling portion 24 operates a number of loads under the control of the microcomputer 20 according to the output signals from the wash water temperature detecting portion 22 and the function selecting portion 23.

A motor forward rotation drive portion 25 includes a motor forward rotation portion 25A for rotating the motor in a forward direction, a triac $T_1$ triggered by the output signal from the drive controlling portion 23, and a resister $R_6$.

A motor reverse rotation drive portion 26 includes a motor reverse rotation portion 26A for rotating the motor in a reverse direction, a triac $T_2$ triggered by the output signal from the drive controlling portion 23, and a resister $R_7$.

A water drain drive portion 27 includes a water drain solenoid valve 27A for draining wash water, a triac $T_3$ triggered by the output signal from the drive controlling portion 23, and a resistor $R_8$.

A water supply drive portion 28 includes a water supply solenoid valve 28A for supplying wash water, a triac $T_4$ triggered by the output signal from the drive controlling portion 23, and a resistor $R_9$.

A heater operating portion 29 includes a heater 2 for heating wash water, a triac $T_5$ triggered by the output signal from the drive controlling portion 23, and a resistor $R_{10}$.

A water level sensing portion 30 is provided with a pressure sensor PS and resistors $R_{11}$ and $R_{12}$ to sense the level of wash water to be supplied.

A display portion 31 displays the completion of each of the washing procedures, the function selection and so on.

A tub cover opening/closing portion 32 includes a tub cover sensing switch 5 for sensing the opening and closing of the tub cover, and resistors $R_{13}$ and $R_{14}$.

A tub cover locking/releasing portion 33 includes a solenoid 33A for locking and releasing the tub cover, a triac $T_6$ triggered by the output signal from the drive controlling portion 23, and a resistor $R_{11}$.

A heater temperature detecting portion 34 according to the present invention includes a resistor $R_{15}$, and a thermistor $Th_1$ for detecting the temperature of the heater 2 in the heater operating portion 29.

A thermostat 36 is connected between the heater operating portion 29 and one side of the transformer T for cutting off the power source of the heater 2 in the event of an abnormal operation of the thermistor $Th_1$ or a temperature of the heater 2 that is above a predetermined level.

A thermostat 37 is connected between the drive controlling portion 24 and the resistor $R_{10}$ of the heater operating portion 29 for cutting off the power source of the heater operating portion 29 in the event of an abnormal operation of the thermistor 6 or a temperature of the wash water that is above a predetermined level.

During operation, the system program controls the system so that the selection of a boiling wash function causes the boiling clothes washing machine to process clothes with hot water in a manner that is the same as in machines being controlled by other washing procedures.

In other words, the drive controlling portion 24 causes the water supply drive portion 28 to supply wash water into the tub 1 according to the output signals of the microcomputer 20. At this time, wash water is supplied to the tub 1 so that it rises to a level that is above the position of the heater 2. The amount of wash water supplied is dependent upon the volume of clothes to be washed. Then, after all of the wash water has been supplied, the heater operating portion 29 is activated so that the heater 2 will heat the wash water. When the wash water reaches a first temperature, for example about 95° C., the power source to the heater 2 is cut off. This is accomplished by using the thermistor 6 to detect the temperature of the wash water. In the event that the temperature of the wash water rises above the first temperature for cutting off the heater power source due to the malfunction of the thermistor 6, the thermostat 37 then detects the temperature of the wash water, and automatically cuts off the power source supply to the heater 2 when the temperature of the wash water has reached a second temperature for cutting off the heater power source, for example 97° C.

In the event of a malfunction or failure of the water level sensor 30 and the microcomputer 20, an insufficient amount of wash water may be supplied to the tub 1, so that the wash water level is lower than the position of the heater 2. In this case, the thermistor 6 and the thermostat 37 cannot detect the temperature of the heater 2, even under an over-heating situation, because they are installed at a location that is spaced away from the heater 2. Therefore, it is not possible to rely on the thermistor 6 and the thermostat 37 to cut off the power source of the heater 2. But, the thermistor $Th_1$ and the thermostat 36 are mounted in the metal bracket 3 in contact with the heater 2 according to the present invention. These elements detect the temperature of the heater 2 to enable the microcomputer 20 to determine whether the heater 2 is operating. First, the thermistor $Th_1$ detects the temperature of the heater 2. If the detected temperature reaches a first over-heating temperature for cutting off the heater power source due to the malfunction of the thermistor 6, the thermostat 36 then detects the temperature of the heater 2, and automatically cuts off the power source supply to the heater 2 when the temperature of the heater 2 has reached a second over-heating temperature for cutting off the heater power source, for example 108° C.

In the preferred embodiment, each of a washing water temperature detecting device and a heater temperature detecting device includes a pair consisting of a thermistor and a thermostat. The thermistor is a device that has a resistance value proportional to its temperature. First, the power source supply to the heater can be swiftly cut off based on the detected temperature data, after two thermistors detect the temperatures of washing water and the heater, respectively. Second, if two thermostats detect the over-heating temperature of washing water and the heater during the failure of a water level sensor and a microcomputer, they automatically stop supplying the power source to the heater.

The control method of a safety system is as follows:

During operation, the system program controls the system so that the selection of a boiling wash function causes a boiling clothes washing machine to process clothes with hot water in a manner that is the same as in other machines being controlled by other washing procedures.

The drive controlling portion 24 causes the water supply drive portion 28 to supply wash water into a tub 1 according to the output signals of the microcomputer 20. At this time, wash water is supplied to the tub 1 so that it rises to a level that is above the position of the heater. The amount of wash water supplied is dependent upon the volume of clothes to be washed. After all of the wash water has been supplied, the heater operating portion 29 is activated so that the heater 2 will heat the wash water. The microcomputer 20 then detects the temperature gradient of the heater through a thermistor $Th_1$. The microcomputer does this by sampling the temperature of the heater 2, as determined by the thermistor $Th_1$, over a predetermined period of time, and then calculating the rate of change of temperature (i.e., the temperature gradient of the heater). If the temperature gradient is over 13° C./min, the microcomputer 20 concludes that the wash water is supplied below the position of the heater 2 and turns off the operation of all loads. However, if the temperature gradient is below 13° C./min, the microcomputer 20 concludes that the wash water is supplied to a normal level and controls the operation of the heater 2 to maintain the first cutoff temperature of a heater power source based on the temperature data detected by a thermistor 6 of a wash water detecting portion 22.

As described above, according to the present invention a safety control system and method of a boiling clothes washing machine comprises a number of paired wash water temperature detecting devices and heater temperature detecting devices, for accurately detecting the actual temperature of wash water so it will have a sufficient boiling effect on clothes to be washed, and for preventing a heater from over-heating.

What is claimed is:

1. In a boiling clothes washing machine including a heater mounted in a tub so that the heater heats wash water to process clothing with hot water, the improvement comprising a safety control system including:

first wash water temperature detecting means mounted at a location of the inner bottom of the tub for detecting the temperature of wash water by means of direct contact with the wash water;

second wash water temperature detecting means mounted at a location of the inner bottom of the tub for detecting the temperature of wash water by means of direct contact with the wash water;

means responsive to said second wash water temperature detecting means for controlling the operation of said heater during an abnormal operation of said first wash water temperature detecting means;

first heater temperature detecting means, mounted in a thermally conductive relationship with said heater, for detecting the temperature of said heater;

second heater temperature detecting means, mounted in a thermally conductive relationship with said heater, for detecting the temperature of said heater;

means responsive to said second heater temperature detecting means for controlling the operation of said heater during an abnormal operation of said first heater temperature detecting means; and means responsive to said first wash water temperature detecting means for cutting off a power source to said heater in response to a detected wash water temperature being greater than a reference water temperature, for determining a temperature gradient from measurements received from said first heater temperature detecting means, for comparing said temperature gradient to a reference temperature gradient value, and for cutting off said power source to said heater in response to said temperature gradient being greater than said reference temperature gradient value, said temperature gradient being defined as a rate of temperature change, and determined from measurements of said detected heater temperature taken during a predetermined time interval.

2. The improvement comprising the safety control system of claim 1, wherein:

each of said first wash water temperature detecting means and said first heater temperature detecting means includes a thermistor, and each of said second wash water temperature detecting means and said second heater temperature detecting means includes a thermostat.

3. In a boiling clothes washing machine including a heater mounted in a tub so that the heater heats wash water to process clothing with hot water, the improvement comprising a safety control system including:

first wash water temperature detecting means mounted at a location of the inner bottom of the tub for detecting the temperature of wash water by means of direct contact with the wash water;

second wash water temperature detecting means mounted at a location of the inner bottom of the tub for detecting the temperature of wash water by means of direct contact with the wash water;

means responsive to said second wash water temperature detecting means for controlling the operation of said heater during an abnormal operation of said first wash water temperature detecting means;

heater temperature detecting means, mounted in a thermally conductive relationship with said heater, for detecting the temperature of said heater; and means responsive to said first wash water temperature detecting means for cutting off a power source to said heater in response to a detected wash water temperature being greater than a reference water temperature, for determining a temperature gradient from measurements received from said heater temperature detecting means, for comparing said temperature gradient to a reference temperature gradient value, and for cutting off said power source to said heater in response to said temperature gradient being greater than said reference temperature gradient value, said temperature gradient being defined as a rate of temperature change, and determined from measurements of said detected heater temperature taken during a predetermined time interval.

4. In a boiling clothes washing machine including a heater mounted in a tub so that the heater heats wash water to process clothing with hot water, the improvement comprising a safety control system including:

wash water temperature detecting means mounted at a location of the inner bottom of the tub for detecting the temperature of wash water by means of direct contact with the wash water;

heater temperature detecting means mounted in a thermally conductive relationship with said heater, for detecting the temperature of said heater; and means responsive to said wash water temperature detecting means for cutting off a power source to said heater in response to a detected wash water temperature being greater than a reference water temperature, for determining a temperature gradient from measurements received from said heater temperature detecting means, for comparing said temperature gradient to a reference temperature gradient value, and for cutting off said power source to said heater in response to said temperature gradient being greater than said reference temperature gradient value, said temperature gradient being defined as a rate of temperature change, and determined from measurements of said detected heater temperature taken during a predetermined time interval.

5. In a boiling clothes washing machine including a heater mounted in a tub so that the heater heats wash water to process clothing with hot water, the improvement comprising a safety control system including:

water temperature detecting means mounted at a location of the inner bottom of the tub for detecting the temperature of wash water by means of direct contact with the wash water;

heater temperature detecting means, mounted in a thermally conductive relationship with said heater, for detecting the temperature of said heater; and a microcomputer, coupled to said water temperature detecting means and to said heater temperature detecting means, for determining a temperature gradient from measurements received from said heater temperature detecting means, comparing said temperature gradient to a reference temperature gradient value, and for generating a control signal for cutting off a power source to said heater in response to any of a set of conditions occurring, said set of conditions including said detected water temperature being greater than a first reference water temperature value, said detected heater temperature being greater than a first reference heater temperature value, and said temperature gradient being greater than said reference temperature gradient value, said temperature gradient being defined as a rate of temperature change, and determined from measurements of said detected heater temperature taken during a predetermined time interval.

6. The improvement comprising the safety control system of claim 5, wherein each of said water temperature detecting means and said heater temperature detecting means includes a thermistor.

7. The improvement comprising the safety control system of claim 5, wherein said system further comprises means, mounted at a location of the inner bottom of the tub for sensing the temperature of wash water by means of direct contact with the wash water, and for cutting off a power source to said heater if said sensed temperature of wash water is greater than a second reference water temperature value, wherein said second reference water temperature value is greater than said first reference water temperature value.

8. The improvement comprising the safety control system of claim 5, wherein said system further comprises means mounted in a thermally conductive relationship with said heater, for sensing a temperature of said heater, and for cutting off a power source to said heater if the sensed temperature of said heater is heater than a second reference heater temperature value, wherein said second reference heater temperature value is greater than said first reference heater temperature value.

9. The improvement comprising the safety control system of claim 5, wherein said reference temperature gradient value is 13° C./min.

* * * * *